US010260829B1

(12) United States Patent
Wright

(10) Patent No.: US 10,260,829 B1
(45) Date of Patent: Apr. 16, 2019

(54) SHOTGUN CONVERSION METHOD AND APPARATUS

(71) Applicant: Robert Wright, Lyons, OR (US)

(72) Inventor: Robert Wright, Lyons, OR (US)

( * ) Notice: Subject to any disclaimer, the term of this patent is extended or adjusted under 35 U.S.C. 154(b) by 0 days.

(21) Appl. No.: 15/825,048

(22) Filed: Nov. 28, 2017

Related U.S. Application Data

(60) Provisional application No. 62/426,930, filed on Nov. 28, 2016.

(51) Int. Cl.

| | |
|---|---|
| ***F41A 5/26*** | (2006.01) |
| ***F41A 11/02*** | (2006.01) |
| ***F41C 7/00*** | (2006.01) |
| ***F41A 9/37*** | (2006.01) |
| *F41C 23/16* | (2006.01) |

(52) U.S. Cl.
CPC ..... *F41A 11/02* (2013.01); *F41A 9/37* (2013.01); *F41C 7/00* (2013.01); *F41C 23/16* (2013.01)

(58) Field of Classification Search
CPC ..... F41A 3/64; F41A 3/66; F41A 5/18; F41A 5/24; F41A 5/26; F41A 5/28; F41A 5/30; F41A 11/00; F41A 11/02
See application file for complete search history.

(56) References Cited

U.S. PATENT DOCUMENTS 2,483,752 A * 10/1949 Buhl ..... F41B 7/006 124/27
3,412,641 A * 11/1968 Biehl ..... F41F 3/045 42/69.01
3,675,534 A * 7/1972 Beretta ..... F41A 3/26 89/185
3,776,095 A * 12/1973 Atchisson ..... F41A 11/02 42/16
4,231,177 A * 11/1980 Foote ..... F41A 11/02 42/16
4,433,611 A * 2/1984 Baumann ..... F41A 5/28 89/193
4,601,123 A * 7/1986 Swearengen ..... F41A 11/02 42/70.01
4,867,039 A * 9/1989 Dobbins ..... F41A 9/35 42/18
4,893,547 A * 1/1990 Atchisson ..... F41A 3/46 89/187.01
4,930,399 A * 6/1990 Trevor, Jr. ..... F41A 3/46 89/185
5,272,956 A * 12/1993 Hudson ..... F41A 5/28 42/72

(Continued)

*Primary Examiner* — Derrick R Morgan
(74) *Attorney, Agent, or Firm* — Schacht Law Office, Inc.; Dwayne Rogge

(57) ABSTRACT

Disclosed herein are modifications to a firearm of the assault (tactical) weapon style which allow those familiar with these sorts of rifles, especially the AR-15, and AR-15 variant rifles, to rapidly gain comfort and precision with a shotgun of the semi-automatic or potentially automatic feed mechanism in that the disclosed shotgun is externally the same and substantially identical externally to the assault weapon to which they are already familiar. In particular, the disclosed shotgun has a receiver, pistol style grip, hand guard, magazine receiver, and stock adapter which is substantially identical to an AR-15 or AAR-15 variant rifle to which they are already accustomed.

10 Claims, 10 Drawing Sheets

(56) References Cited

U.S. PATENT DOCUMENTS 5,429,034 A * 7/1995 Badali ..... F41A 5/28 89/191.02
5,634,288 A * 6/1997 Martel ..... F41A 5/18 42/71.01
6,070,352 A * 6/2000 Daigle ..... F41A 11/02 42/49.02
7,162,823 B2 * 1/2007 Schoppman ..... F41A 11/04 42/75.01
7,418,898 B1 * 9/2008 Desomma ..... F41A 5/30 89/191.02
8,181,563 B1 * 5/2012 Peterken ..... F41A 11/02 89/191.01
8,418,390 B1 * 4/2013 Wright ..... F41A 9/61 42/49.01
8,528,458 B2 * 9/2013 Windauer ..... F41A 5/28 89/193
9,194,635 B1 * 11/2015 Gibbens ..... F41A 3/12
9,677,846 B1 * 6/2017 Vankeuren, III ..... F41C 23/20
9,719,739 B2 * 8/2017 Windauer ..... F41A 5/28
9,791,229 B1 * 10/2017 Cross ..... F41A 11/00
9,810,495 B2 * 11/2017 Gomez ..... F41A 3/38
9,857,136 B2 * 1/2018 Hayes ..... F41A 21/10
9,869,521 B1 * 1/2018 Huang ..... F41A 5/18
9,903,675 B2 * 2/2018 Cassels ..... F41A 5/28
2006/0065112 A1 * 3/2006 Kuczynko ..... F41A 5/28 89/193
2006/0283318 A1 * 12/2006 Beaty ..... F41A 5/26 89/193
2008/0216375 A1 * 9/2008 Barrett ..... F41A 3/66 42/16
2009/0194088 A1 * 8/2009 Tippmann, Jr. ..... F41A 11/00 124/74
2010/0000400 A1 * 1/2010 Brown ..... F41A 5/18 89/191.01
2010/0024636 A1 * 2/2010 Winge ..... F41A 5/26 89/193
2010/0186582 A1 * 7/2010 Juarez ..... F41A 5/28 89/191.01
2010/0218671 A1 * 9/2010 Mayberry ..... F41A 5/28 89/192
2011/0226227 A1 * 9/2011 Douglas ..... F41B 11/57 124/77
2012/0060809 A1 * 3/2012 Macy ..... F41B 11/50 124/41.1
2012/0137872 A1 * 6/2012 Crommett ..... F41A 5/28 89/193
2012/0152104 A1 * 6/2012 Audibert ..... F41A 5/24 89/191.01
2014/0060312 A1 * 3/2014 Ruck ..... F41A 5/28 89/193
2014/0076149 A1 * 3/2014 Adams ..... F41A 5/28 89/192
2014/0090550 A1 * 4/2014 Wilcox ..... F41A 5/28 89/193
2014/0190344 A1 * 7/2014 Kenney ..... F41A 5/26 89/193
2014/0224114 A1 * 8/2014 Faxon ..... F41A 15/14 89/193
2014/0230297 A1 * 8/2014 Larson, Jr. ..... F41A 17/38 42/6
2014/0331535 A1 * 11/2014 Robinson ..... F41A 3/66 42/6
2015/0113848 A1 * 4/2015 Monveldt ..... F41C 7/02 42/16
2015/0176933 A1 * 6/2015 Adams ..... F41A 5/28 89/191.02
2015/0176938 A1 * 6/2015 Micklethwaite ..... F41A 19/18 89/127
2015/0219416 A1 * 8/2015 Chvala ..... F41C 23/04 42/71.01
2015/0260470 A1 * 9/2015 Foster ..... F41A 3/72 89/193
2015/0308764 A1 * 10/2015 Kenney ..... F41A 5/26 89/193
2016/0033225 A1 * 2/2016 Selvetti ..... F41A 21/482 89/14.05
2016/0047614 A1 * 2/2016 Larson, Jr. ..... F41A 5/28 89/191.01
2016/0161200 A1 * 6/2016 Windauer ..... F41A 5/28 89/193
2016/0178299 A1 * 6/2016 Cassels ..... F41A 5/28 89/193
2016/0209138 A1 * 7/2016 DeSomma ..... F41A 5/28
2016/0265860 A1 * 9/2016 Schilling ..... F41A 5/28
2016/0298918 A1 * 10/2016 Baker ..... F41A 9/65
2016/0327354 A1 * 11/2016 DiChario ..... F41A 9/70
2017/0067715 A1 * 3/2017 Conant ..... F41C 7/02
2017/0138682 A1 * 5/2017 Larson, Jr. ..... F41A 5/28
2017/0284760 A1 * 10/2017 Maffett ..... F41A 21/48
2017/0336159 A1 * 11/2017 Kitchen ..... F41A 5/26

* cited by examiner

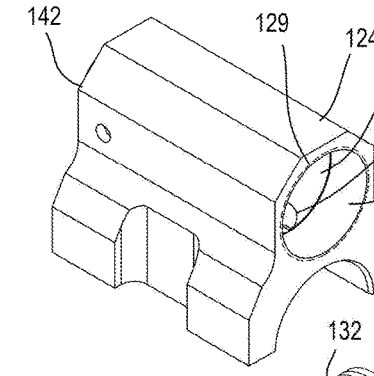
Fig. 62
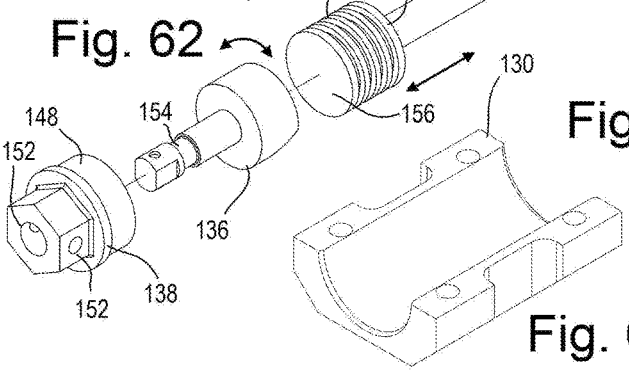
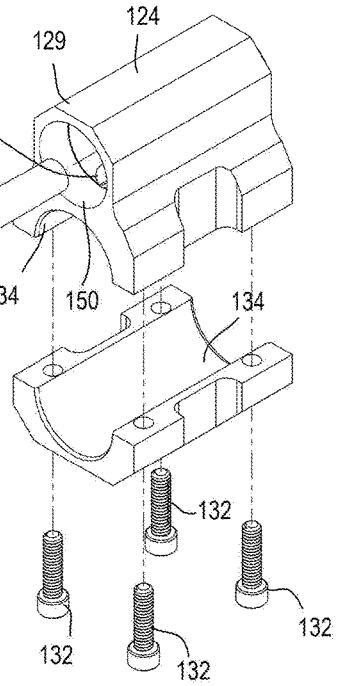
Fig. 61
Fig. 63
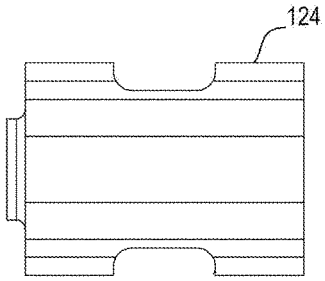
Fig. 64
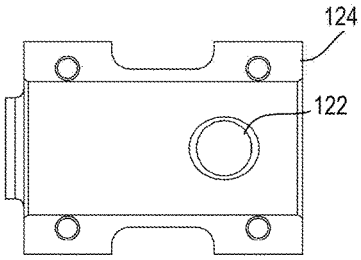
Fig. 65
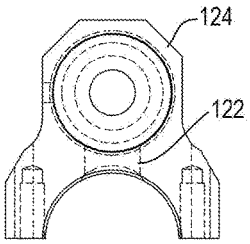
Fig. 68
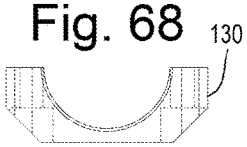
Fig. 69
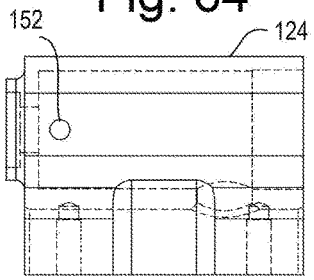
Fig. 66
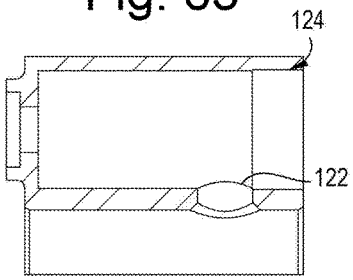
Fig. 67
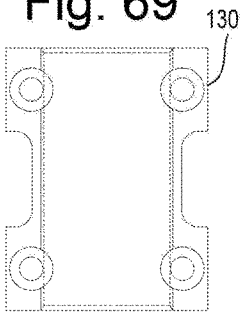
Fig. 70

SHOTGUN CONVERSION METHOD AND APPARATUS

RELATED APPLICATIONS

This application relates to, and claims priority of U.S. Provisional Application Ser. No. 62/426,930 filed Nov. 28, 2016, incorporated herein by reference.

BACKGROUND OF THE DISCLOSURE

Field of the Disclosure

This disclosure relates to the field of the firearm modifications, particularly to a tactical style rifle such as an AR-15 being modified to fire shotgun shells.

BRIEF SUMMARY OF THE DISCLOSURE

Disclosed herein is a shotgun conversion utilizing an AR-15 or AR-15 variant lower modified to accept and fire shotgun shells.

Also disclosed is a barrel mounting system allowing for a slide-in barrel with a removable gas block assembly attached thereto.

To facilitate assembly of one example, a stock adapter is mounted via tapered vertical dovetails to the rear end of a receiver component of a shotgun.

The receiver for a tactical style shotgun disclosed herein may comprise two aluminum components which are vertically separated and laterally attached to each other via removable fasteners.

Also shown is a magazine release mechanism attached to a shotgun magazine release catch wherein the trigger release mechanism extends longitudinally rearward at least to a vertical plane aligned with a trigger of a firearm.

One example of a firearm carrier is disclosed, comprising laterally extending wings which slide within grooves in a receiver of a firearm, the firearm carrier further having a plurality of planar surfaces which slide against planar surfaces within the receiver.

BRIEF DESCRIPTION OF THE SEVERAL VIEWS OF THE DRAWINGS

FIG. 61 is an isometric exploded view of a gas block assembly of the shotgun conversion shown in FIG. 1.

FIG. 62 is an isometric view of the upper gas block component of the gas block assembly shown in FIG. 61.

FIG. 63 is a top isometric view of a lower gas block component of the gas block assembly shown in FIG. 61.

FIG. 64 is a top view of the upper gas block component shown in FIG. 62.

FIG. 65 is a bottom view of the upper gas block component shown in FIG. 62.

FIG. 66 is a side view of the upper gas block component shown in FIG. 62 wherein the opposing side view is substantially a mirror image thereof.

FIG. 67 is a side cutaway view of the upper gas block component shown in FIG. 62.

FIG. 68 is an end view of the upper gas block component shown in FIG. 62.

FIG. 69 is an end view of the lower gas block component of the gas block assembly shown in FIG. 61.

FIG. 70 is a bottom view of the lower gas block component shown in FIG. 69.

DETAILED DESCRIPTION OF THE DISCLOSURE

Figure 1:
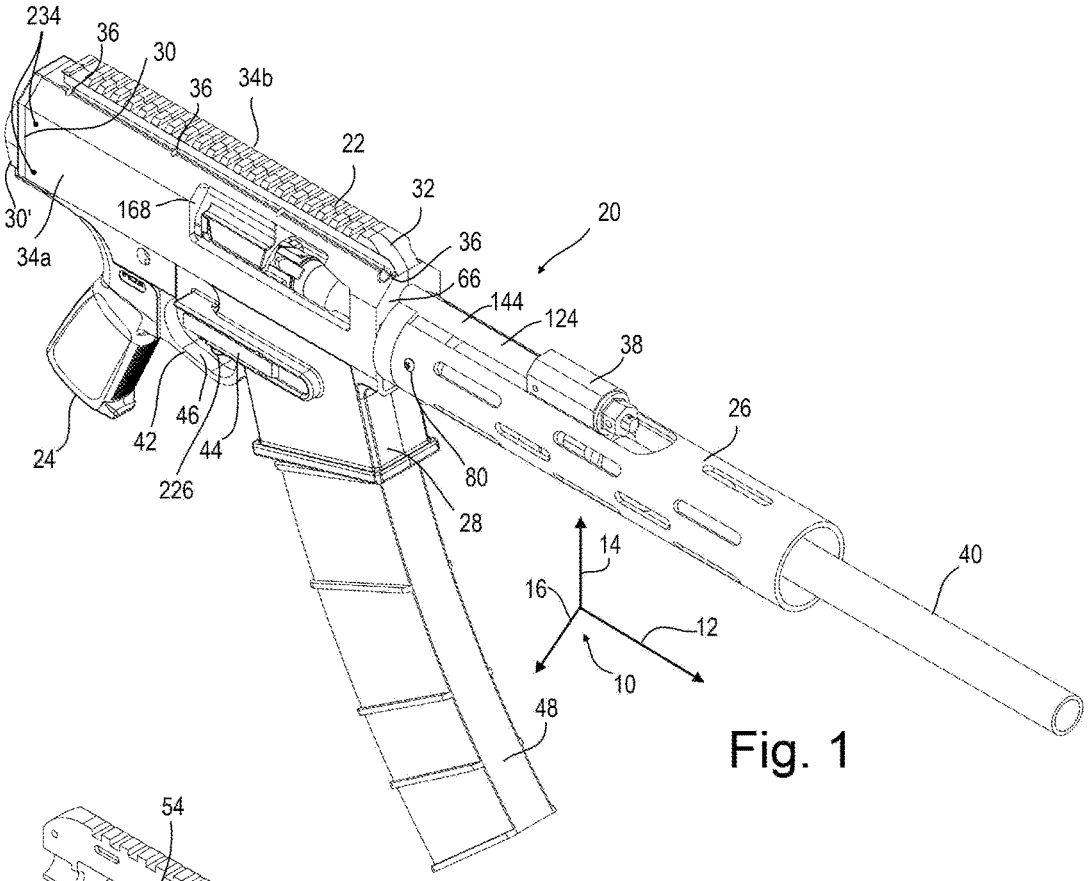
FIG. 1 is a front isometric view of one example of the disclosed shotgun conversion.
Figure 2:
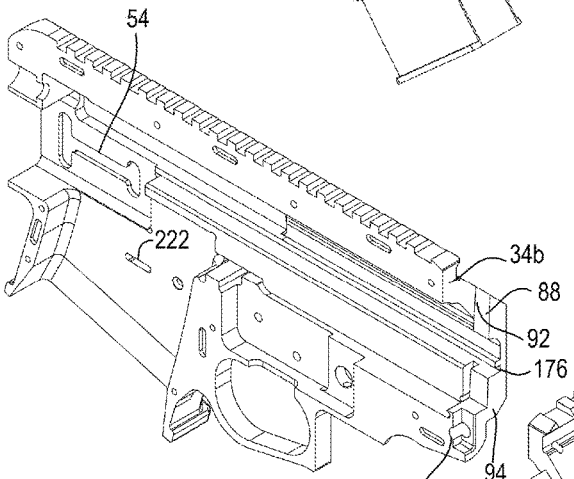
FIG. 2 is an internal view of the right side section of the firearm upper receiver component of the example shown in FIG. 1.
Figure 3:
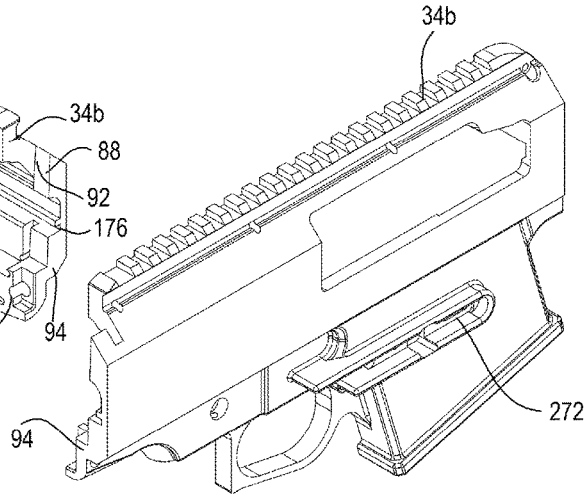
FIG. 3 is an external view of the right side section of the firearm upper receiver.
Figure 4:
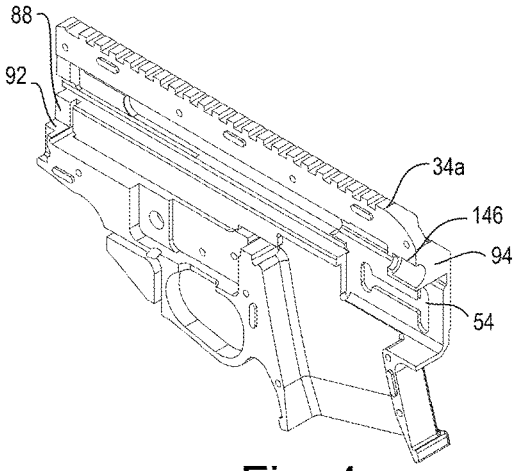
FIG. 4 is an internal view of the left side section of the firearm upper receiver component of the example shown in FIG. 1.
Figure 5:
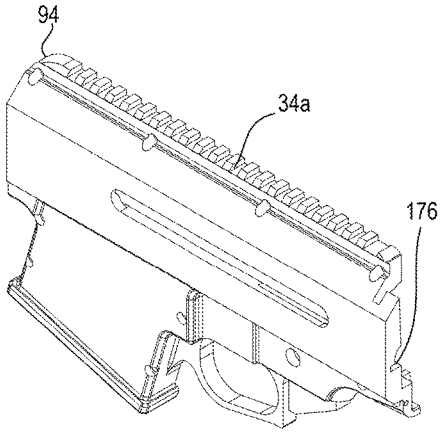
FIG. 5 is an external view of the left side section of the firearm upper receiver.
Figure 6:
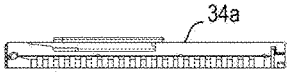
FIG. 6 is a top view of the left side section of the firearm upper receiver.
Figure 7:
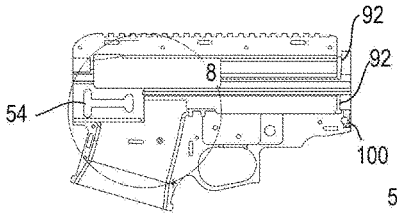
FIG. 7 is an internal view of the right side section shown in FIG. 2.
Figure 8:
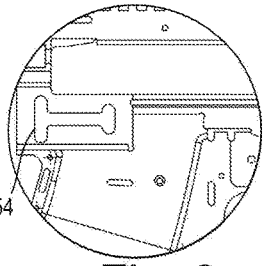
FIG. 8 is a detail view of the region 8 shown in FIG. 7.
Figure 9:
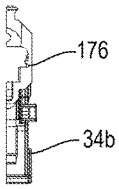
FIG. 9 is a rear view of the right side section shown in FIG. 4.
Figure 10:
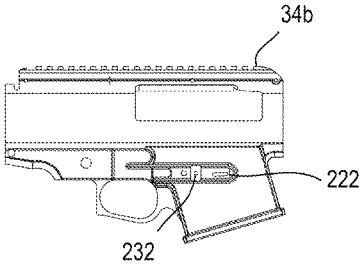
FIG. 10 is a side view of the right side section shown in FIG. 4.
Figure 11:
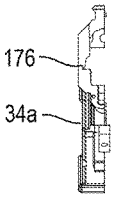
FIG. 11 is a rear view of the left side section shown in FIG. 2.
Figure 12:
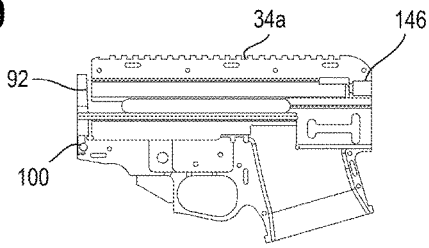
FIG. 12 is an internal view of the left side section shown in FIG. 4.
Figure 13:
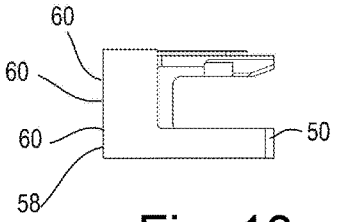
FIG. 13 is a top view of one example of a locking lug component.
Figure 14:
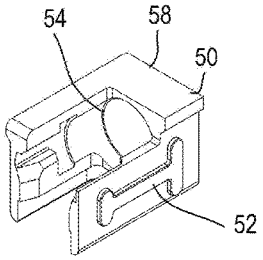
FIG. 14 is a rear isometric view of the locking lug shown in FIG. 13.
Figure 15:
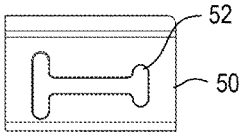
FIG. 15 is a left side view of the locking lug shown in 13.
Figure 16:
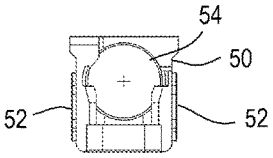
FIG. 16 is a rear view of the locking lug shown in FIG. 13.
Figure 17:
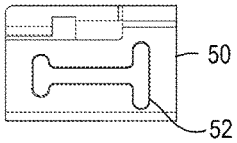
FIG. 17 is a right side view of the locking lug shown in FIG. 13.
Figure 18:
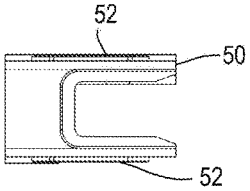
FIG. 18 is a bottom view of the locking lug shown in FIG. 13.

Disclosed herein are modifications to a firearm of the assault (tactical) weapon style which allow those familiar with these sorts of rifles, especially the AR-15, and AR-15 variant rifles, to rapidly gain comfort and precision with a shotgun of the semi-automatic or potentially automatic feed mechanism in that the disclosed shotgun is externally the same and substantially identical externally to the assault weapon to which they are already familiar. In particular, the disclosed shotgun 20 has a receiver 22, pistol style grip 24, hand guard 26, magazine receiver 28, and stock adapter 30 which is substantially identical to an AR-15 or AAR-15 variant rifle to which they are already accustomed. The user may use components of the AR-15 or AR-15 variant lower receivers including the trigger, safety, stock, trigger pins, firing pin, springs, and plungers.

Before continuing, an axes system 10 is disclosed in the drawings and particularly shown in FIG. 1. This axes system 10 designating relative orientations of components of the modified shotgun 20 via a longitudinal axis 12 generally aligned with the bore of the barrel of the firearm, a vertical axis 14 orthogonal to the longitudinal axis 12 and generally passing through the trigger guard, grip, and magazine receiver. Also disclosed is a lateral axis 16 which is orthogonal to the vertical axis 14 and longitudinal axis 12.

The disclosed modified shotgun 20 includes novel features not previously known to exist which will enhance function, ease of manufacturing, adaptability to the needs and desires of the shooter, etc. For example, the receiver 22 is longitudinally/vertically split 32 thus forming a right upper 34*a* and a left upper 34*b*. These two components in one example are attached by way of fasteners 36 such as machine screws. In one example, some components such as the right upper 34*a* and left upper 34*b* may be made of a lightweight material such as aluminum. In one example, this is facilitated when the chamber components of the modified shotgun 20 are reinforced by more structurally resilient materials such as steel which are inserted into the receiver 22 and held in place therein securely. This combination substantially reducing the weight of the overall shotgun 20.

Another novel feature is an easily adjustable gas block assembly 38 which allows a user to quickly and easily adjust the gas volume (flow) and pressure used to return the bolt and carriage components rearward within the receiver 22 upon firing of a cartridge to eject the spent cartridge and then to insert (chamber) an unfired cartridge. This adjustable gas block assembly 125 allows the user to operate the firearm with varying loads (volume of powder in the cartridge) and also allows an interchangeable barrel 40. As the barrel length affects the gas pressure and volume returning to move the carriage and bolt rearward, adjustment is beneficial and required in some applications.

In addition, a series of apparatuses and methods are disclosed herein which allow for implementation of a slide-in interchangeable barrel 40. Such an assembly allows the user to easily reconfigure the firearm for different firing modes utilizing barrel lengths for example between 30 inches to 8 inches. In one example a barrel ported to 14 inches is particularly effective.

Another novel feature is shown wherein the stock adapter 30 comprises a plate which covers the rearward end of the receiver 22 and slides into position and is maintained in position partially via a plurality of vertically tapered sliding dovetails which allow for easy removal and installation of the stock adapter 30, and also provide a very secure attachment of the stock adapter 32 and the receiver 22.

Also disclosed is a magazine release mechanism which is more easily utilized by a user with their hand on the pistol grip 24 and finger near the trigger guard 42. This is accomplished by extending the magazine release 44 longitudinally rearward toward a vertical plane 46 which is orthogonal to the barrel 40 of the shotgun 20. By extending the magazine release 44 longitudinally rearward to the plane 46 crossing the trigger, a user need not release the grip 24 but may simply raise their finger laterally outward and upward to release the magazine 48 as the magazine release 44 is actuated.

Drawing from federal and state law definitions, the term assault weapon used herein refers primarily to automatic rifles, semi-automatic rifles, pistols, and shotguns that are able to accept detachable magazines and possess one or more other features, the term "tactical weapon" used herein is intended to encompass such weapons.

Common attributes used in definitions of tactical (assault) weapons include:

- Semi-automatic or automatic firearm capable of accepting a detachable magazine.
- Folding, removable, or telescoping (collapsible) stock, which reduces the overall length of the firearm.
- A pistol grip that protrudes conspicuously beneath the action of the weapon.
- Bayonet lug, which allows the mounting of a bayonet.
- Threaded muzzle end of barrel, which can accept devices such as a flash suppressor, suppressor, compensator or muzzle brake.
- Grenade launcher.
- Barrel shroud (hand guard), which prevents burning of shooter's arm or hand as a safety device.

The term AR-15 colloquially refers to a lightweight, intermediate cartridge magazine-fed, air-cooled semi-automatic firearm (rifle) of the assault (tactical) style rifle with a rotating lock bolt. The bolt is actuated by direct impingement gas-operation or long/short stroke piston operation.

The prototype AR-15 rifle was designed by ArmaLite as a selective fire weapon for military purposes.

The term "AR-15" signifies "Armalite rifle, design 15". The trademark "AR15" or "AR-15" is registered to Colt, which requires the term to be used only to refer to their products. Other manufacturers make AR-15 clones and variants marketed under separate designations, although these are frequently (colloquially) referred to as AR-15s.

FIGS. 1-12 show the left upper 34*a* and the right upper 34*b* from various angles. The left upper being the left half or section of the receiver 22 in an arrangement wherein the barrel 40 is defined as the front of the firearm, the stock adapter 30 defines the rear of the modified shotgun 20, and the grip 24 defines the bottom of the modified shotgun 20. Clearly the modified shotgun 20 can be rotated and still functional in other orientations. These directions are used for a description of the relative placement of components and are not intended to limit the disclosure, claims, nor apparatus, to a single orientation as to left, right, forward, etc.

Looking to FIGS. 13-18 is shown one example of a locking lug 50. The locking lug 50 in one form is produced of steel or other rigid and structurally stable material. This allows other components such as the receiver 22, especially the left upper 34*b* and right upper 34*a*, to be made of aluminum or other lighter and less structurally rigid material.

In this example, the locking lug 50 comprises protrusions 52 on either lateral side thereof. These protrusions 52 are shaped cooperatively to indents 54 of the right upper 34*a* and left upper 34*b* thus, as the locking lug 50 is placed between the right upper 34*a* and left upper 34*b*, and the fasteners 36 engaged to attach these two sections, the locking lug 50 is held in place relative to the receiver 22. The locking lug 50 furthermore having a surface defining an opening 54 through which passes the chamber end 56 of the barrel 40 as the barrel 40 is attached to the receiver 22.

Figure 87:
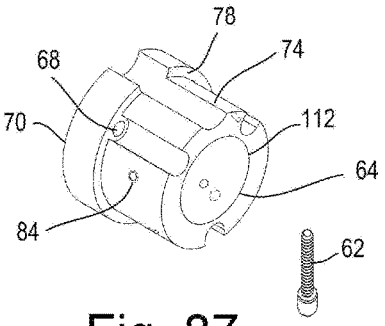
FIG. 87 is an isometric view of a barrel receiver component of the assembly shown in FIG. 1.

The locking lug 50 also comprises on its forward end 58 a plurality of surfaces defining female threaded openings 60 into which are threaded fasteners 62 as shown in FIG. 87. These fasteners 62 attach the barrel receiver 64 at the forward end 66 of the receiver 22. The forward end 58 of the locking lug 50 when installed between the left upper 34*b* and right upper 34*a* is substantially co-planar with the forward surface 66 of the receiver 22. The fasteners 62 pass through openings 68 and are threaded into the female threaded openings 60, thus tensioning the rearward surface 70 of the barrel receiver 64 against the forward end 58 of the locking lug 50. Once the barrel receiver 64 is mounted to the receiver 22, the hand guard 72 is repositioned longitudinally onto the substantially cylindrical surface 74 of the barrel receiver 64. The hand guard is moved to the rearward end 76 of the hand guard 72 and contacts the protruding step 78 of the barrel receiver 64, thus assuring proper longitudinal and rotational placement of the hand guard 72 relative to the barrel receiver 64. Once properly placed, fasteners 80 fit through surfaces defining openings 82 in the hand guard 72 and are received by female threaded surfaces 84 in the barrel receiver 64. Alternatively, a bayonet style mount, adhesives, welding, brazing or other attachment methods may be utilized to attach the hand guard 72 to the barrel receiver 64.

At the opposing longitudinal end of the receiver 22, the stock adapter 30 previously mentioned is attached to the receiver 22 after attachment of the right upper 34*a* to the left upper 34*b*. The stock adapter 30 in this example comprises tapered surfaces 86 which engage surfaces 88 (see FIGS. 2 and 4) such that as the stock adapter 30 is moved downward into position, the tapered surfaces 86 contact surfaces 88 and securely mate therewith.

The drawings also show an example with lateral protrusions 90 extending laterally left and right from the center portion of the stock adapter 30. These lateral protrusions 90 fit with in surfaces defining grooves 92 in the forward end 94 of each of the right upper 34*a* and left upper 34*b*. As can be seen in the example shown in FIGS. 7 and 12, the grooves 92 may be tapered longitudinally such that they are wider at the open end and narrower at the bottom end to ease in installation and alignment of the stock adapter 30. The protrusions 90 may be similarly tapered. The stock adapter 30 furthermore having one or more surfaces 94 and 96 forming a butt stock receiver 98. One of many butt stocks known in the art may be inserted into the butt stock receiver 98 and extend longitudinally rearward therefrom towards a user's shoulder or other support to enhance accuracy as the modified shotgun 20 recoils during firing.

Figure 19A:
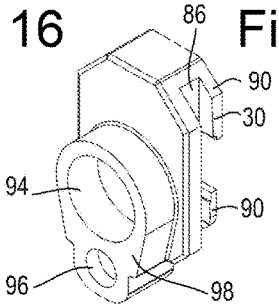
FIG. 19*a* is a rear isometric view of one example of a stock adapter component shown in FIG. 1.
Figure 19B:
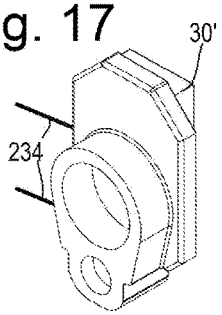
FIG. 19*b* is a rear isometric view of another example of a stock adapter component shown in FIG. 1.
Figure 20:
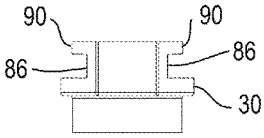
FIG. 20 is a top view of the stock adapter component shown in FIG. 19.
Figure 21:
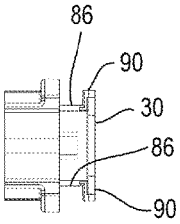
FIG. 21 is a bottom view of the stock adapter component shown in FIG. 19.
Figure 22:
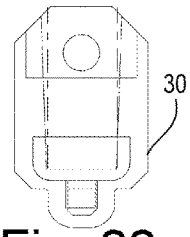
FIG. 22 is a front hidden line view of the stock adapter shown in FIG. 19.

In another Example, as shown in FIG. 19*b*, the stock adapter 30' does not include the protrusions 90 and is longitudinally positioned into the receiver 22 and held in place by pins 234.

Once the stock adapter 30 is installed, it may be held in place by way of a fastener passing through surfaces defining voids 100 in the receiver 22. This fastener engages a surface 102 in the stock adapter 30 which prohibits vertical movement of the stock adapter 30 relative to the other components of the receiver 22.

Figure 26:
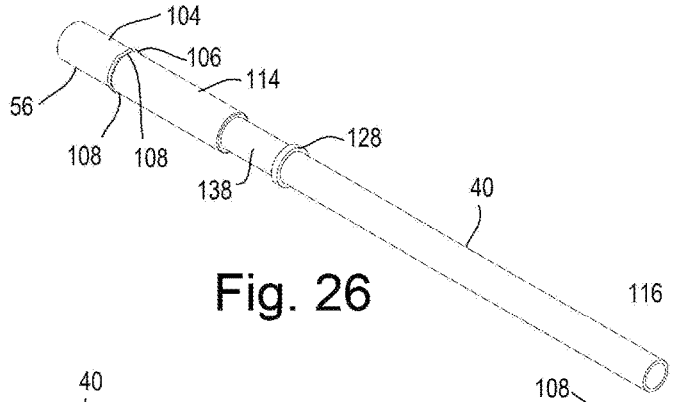
FIG. 26 is a front isometric barrel of one example of a barrel component shown in FIG. 1.

Looking to FIG. 26 is shown one example of a previously mentioned interchangeable barrel 40. The barrel 40 has a chamber end 56 with a slide-in region 104 which passes through the aforementioned surface 54 in the locking lug 50 up to a stopper ring 106. The stopper ring 106 is slightly larger in diameter than the circumference of the chamber end 56 and thus prohibits insertion of the chamber end 56 into the locking lug 50 beyond the stopper ring 106.

Figure 27A:
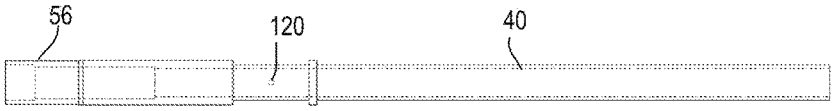
FIG. 27*a* is a top hidden line view of the barrel component shown in FIG. 26.
Figure 27B:
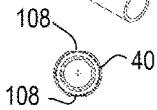
FIG. 27*b* is a front end view of the barrel component shown in FIG. 26.
Figure 28:
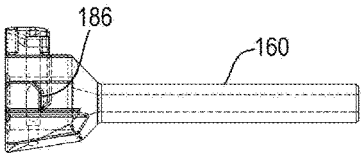
FIG. 28 is a top hidden line view of a bolt body component of the shotgun conversion shown in FIG. 1.
Figure 30:
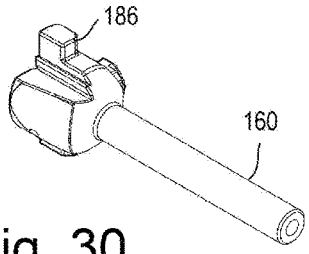
FIG. 30 is a side isometric view of the bolt body component shown in FIG. 28.
Figure 29:
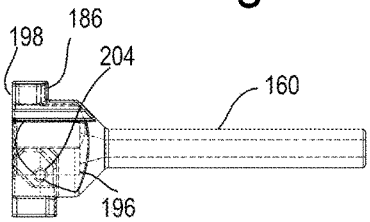
FIG. 29 is a side hidden line view of the bolt body component shown in FIG. 28.
Figure 31:
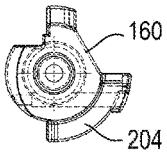
FIG. 31 is an end view of the bolt body component shown in FIG. 28.
Figure 32:
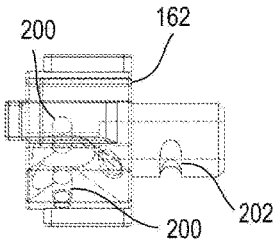
FIG. 32 is a top hidden line view of a breech face component of the shotgun conversion shown in FIG. 1.
Figure 33:
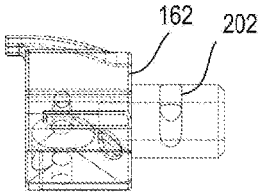
FIG. 33 is a side hidden line view of the breech face component shown in FIG. 32.
Figure 88:
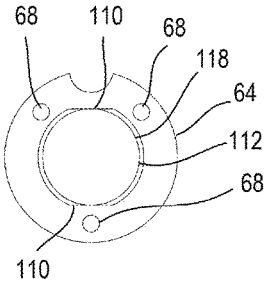
FIG. 88 is a rear view of the barrel receiver shown in FIG. 87.
Figure 89:
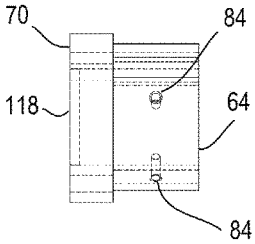
FIG. 89 is a side hidden line view of the barrel receiver shown in FIG. 87 wherein the opposing side view is substantially a mirror image thereof.
Figure 90:
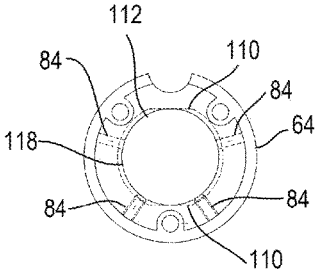
FIG. 90 is an end view of the barrel receiver shown in FIG. 87 from the opposing end as shown in FIG. 88.

It can also be particularly seen in FIG. 27*b* that the stopper ring 106 comprises a plurality of non-cylindrical portions 108. In one example, these non-cylindrical portions 108 are substantially flat and parallel. These non-cylindrical portions 108 are shaped and sized to coordinate with seating surfaces 110 of the barrel receiver 64 such as can be seen in FIG. 88 or 90. The inner surface 112 of the barrel receiver 64 is sized to receive the second region 114 of the barrel 40 longitudinally forward of the stopper ring 106. Thus, as the barrel receiver fixed 64 is positioned longitudinally down the barrel 40 from the muzzle end 116 to the stopper ring 106 and then rotated into place such that the non-cylindrical surfaces 108 engage surfaces 110 and the stopper ring 106 slides into a substantially cylindrical recess 118. Once engaged in this manner, the fasteners 62 may be inserted through openings 68 and threaded into surfaces 60 thus fixing the barrel 40 to the receiver 22.

In the examples shown, the barrel 40 has a surface defining an opening or gas port 120 in the top thereof. When the gas block assembly 125 is correctly installed, this gas port 120 is aligned with a surface defining a vent passage 122 in the upper gas block 124 component of the gas block assembly 125 as shown in FIG. 61-70. The vent passage 122 extends into an inner chamber 129 of the upper gas block 124. The upper gas block 124 when properly installed is fixed to the barrel 40 between the surface 114 and a second stopper ring 128 by way of a lower gas block 130 which is attached to the upper gas block 124 by way of fasteners 132. Thus inner surfaces 134 of the lower gas block 130 and upper gas block 124 clamp around the outer surface of the barrel 140 between the surface 114 and the second stopper ring 128 thus positioning the vent passage 122 in fluid connection with the gas port 120.

Figure 58:
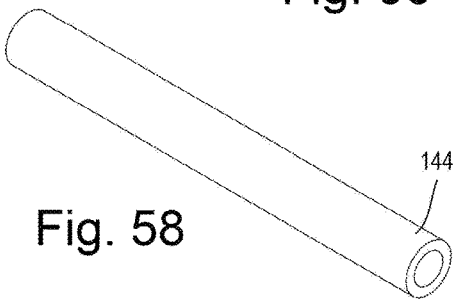
FIG. 58 is an isometric view of a gas tube component of the shotgun conversion shown in FIG. 1.
Figure 59:
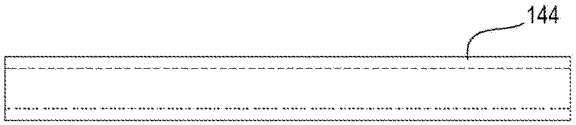
FIG. 59 is a side hidden line view of the gas tube component shown in FIG. 58 with all side views being substantially identical thereto.
Figure 60:
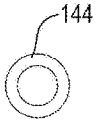
FIG. 60 is an end view of the gas tube component shown in FIG. 58 with the opposing end view being identical thereto.
Figure 71:
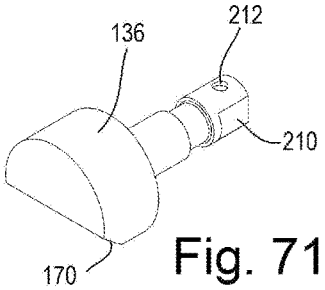
FIG. 71 is an isometric view of a gas plug component of the gas block assembly shown in FIG. 61.
Figure 72:
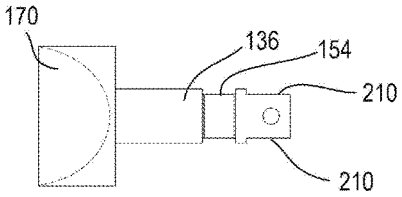
FIG. 72 is a top hidden line view of the gas plug shown in FIG. 71.
Figure 73:
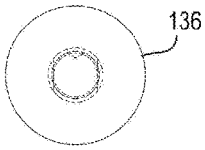
FIG. 73 is an end hidden line view of the gas plug component shown in FIG. 71.
Figure 74:
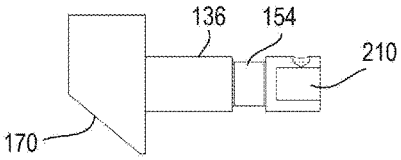
FIG. 74 is a side view of the gas plug component shown in FIG. 71 wherein the opposing side view is a mirror image thereof.
Figure 75:
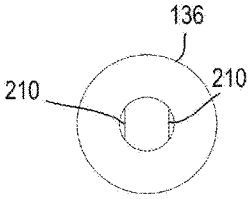
FIG. 75 is an end view of the gas plug component shown in FIG. 71 from the opposing and as shown in FIG. 73.
Figure 77:
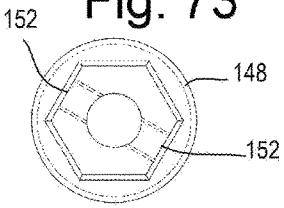
FIG. 77 is an end view of the gas block plug shown in FIG. 76.
Figure 78:
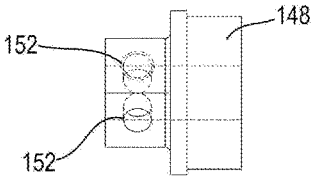
FIG. 78 is a side view of the gas block plug shown in FIG. 76 with the opposing side view being substantially a mirror image thereof.
Figure 76:
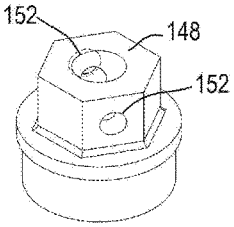
FIG. 76 is an isometric top view of the gas block assembly shown in FIG. 63.
Figure 79:
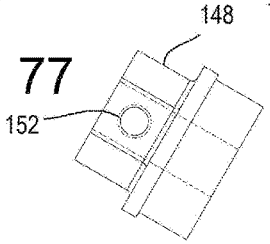
FIG. 79 is another side view of the gas block plug shown in FIG. 76 from a different angle as that shown in FIG. 79.
Figure 83:
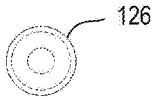
FIG. 83 is a hidden line view of the piston component shown in FIG. 81.
Figure 81:
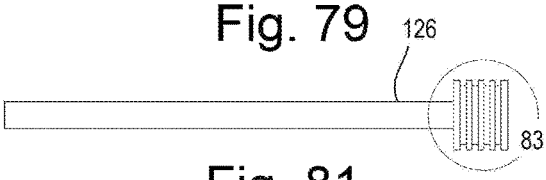
FIG. 81 is a top view of the piston component shown in FIG. 81 with the bottom view and side views being substantially identical thereto.
Figure 82:
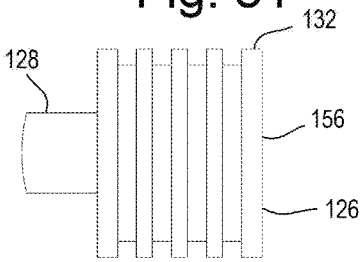
FIG. 82 is a detail view of the region 83 shown in FIG. 82.
Figure 80:
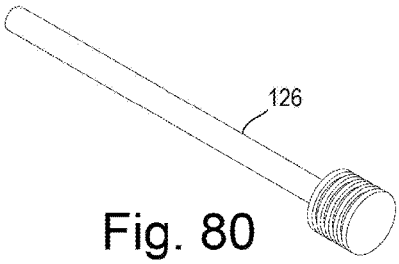
FIG. 80 is an isometric view of a piston component of the gas block assembly shown in FIG. 61.
Figure 84:
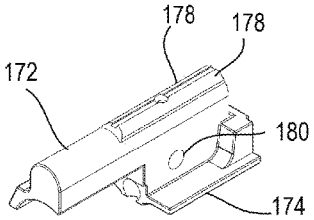
FIG. 84 is an isometric view of a carrier component of the assembly shown in FIG. 1.

The rearward end 142 of the upper gas block 124 is attached to a gas tube 144 as seen in FIG. 58-60. The gas tube 144 having an opposing longitudinal end which inserts into a female surface 146 of the receiver 22. In addition, a piston 126 comprising a rod component 128 and a sealing component 130 are inserted into the upper gas block 124. In this arrangement, the outer surface 133 of a plurality of radially extending rings engage the inner surface 134 of the upper gas block 124 and seal thereto prohibiting the free flow of gas past the sealing component 130. A gas plug 136 is then inserted into the upper gas block 124 and held in place by way of a gas block (gas cap) 138. Wherein the radially outer surface 148 of the gas block 138 threads into a female threaded surface 150 of the upper gas block 124, rotation of the gas block 138 will thus result in longitudinal movement of the gas plug 136. To maintain the gas plug 136 in position, fasteners may be threaded or otherwise affixed into surfaces defining voids 152 and extending into a channel or grooves 154 thus prohibiting longitudinal movement of the gas plug 136 relative to the gas block 138.

In this arrangement, as the gas block 138 is rotated, the threaded surfaces cause the gas block 138 and attached gas plug 136 to move longitudinally forward and rearward relative to the upper gas block 124 thus adjusting the volume and pressure of air passing through the vent passage 122 upon the face 156 of the piston 126. This adjusts the speed and distance that the piston 126 moves rearward. The opposing end of the piston 126 fits within a surface 158 of the carrier 172 and presses against an inner surface of the carrier 172. Upon firing of the modified shotgun 20 the carrier 172 moves rearward and forces the attached bolt body 160 and attached breech face 162 longitudinally rearward. The extractor component 164 is pivotably attached to the breech face 162. The extractor component 164 has a catch edge or seer surface 166 which pulls the casing of a spent cartridge rearward and upon moving sufficiently rearward, the extractor 164 ejects the spent cartridge through an ejection port 168 in the side of the receiver 22.

Looking to FIGS. 71-75 is shown one example of the gas plug 136 which has an angled surface 170. The angled surface 170 forming a small open region adjacent the vent passage 122 allowing the expanding gases with in the barrel 40 to travel through the vent passage 122 and exert force upon the face 156 of the piston 126 driving the piston rearward. A non-cylindrical surface 210 on the protruding portion of the gas plug 136 may be engaged by a tool to ensure that the gas plug 136 does not rotate when the gas block 148 is rotated. Alternatively, one suggested the gas plug 136 may be rotated independent of the gas block 148 such that an indicator 212 is correctly displayed. In this example, a marking on the top of the protruding portion will be facing away from the barrel 40 when the gas plug 136 is correctly rotated ensuring that the angled surface 170 is above and in fluid contact with the vent passage 122.

The carrier 172 in this example has sliding rails 174 on either lateral side thereof which fit within grooves 176 in the receiver 22. As these sliding rails 174 slide longitudinally within the grooves 176, longitudinal movement of the carrier 172 relative to the receiver 22 is permitted, however vertical, lateral, as well as rotational movement of the carrier 172 relative to the receiver 22 is prohibited. In addition, the carrier 172 of this example comprises a plurality of flat surfaces 178 which contacts inner flat surfaces 180 of the receiver 22 to further prohibit rotational, vertical, and lateral movement of the carrier 172 relative to the receiver 22. Testing has shown that such an arrangement improves efficiency by reducing sliding friction of the carrier 172 relative to the receiver 22.

The carrier 172 also has a surface defining an opening in the lateral side thereof. This opening forming a charge handle receiver 181 into which is fitted a charge handle well-known in the art.

As shown, the rearward end 182 of the carrier 172 comprises a notch 184 which engages protrusion 186 of the bolt body 160 such that the bolt body 160 moves longitudinally with the carrier 172 but is allowed some degree of rotation relative thereto due to the shape and dimensions of the notch 184.

Figure 48:
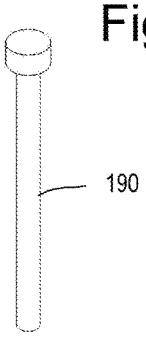
FIG. 48 is an isometric view of a guide rod component of the shotgun conversion shown in FIG. 1.
Figure 49:
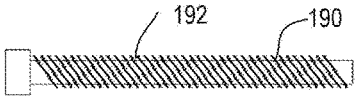
FIG. 49 is a side view of the guide rod component shown in FIG. 48.
Figure 50:
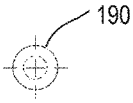
FIG. 50 is a rear view of the guide rod component shown in FIG. 48.
Figure 85:
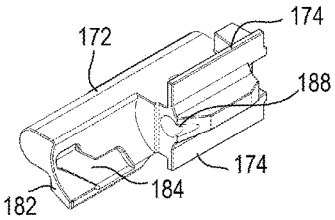
FIG. 85 is an isometric view of the carrier component shown in FIG. 84 from a different angle.
Figure 86:
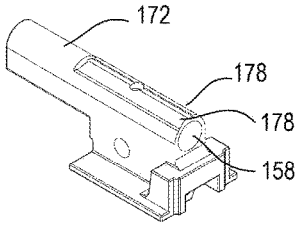
FIG. 86 is another isometric view of the carrier component shown in FIG. 84 from yet another angle.

Also as can be seen in FIG. 85 a guide rod receiver 188 is shown which passes longitudinally through the carrier 172. The guide rod 190 such as shown in FIG. 48-50 passes through the guide rod receiver 188 in the carrier 172 and has recoil springs 192 fitted thereabout. The recoil springs 192 bias the carrier 172 and attached components including the piston 126 forward in anticipation of firing of another cartridge, repeating the cycle.

Figure 34:
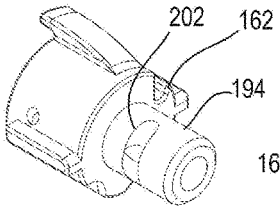
FIG. 34 is a side isometric view of the breech face component shown in FIG. 32.
Figure 35:
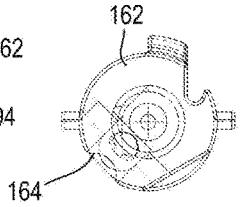
FIG. 35 is a front hidden line view of the breech face component shown in FIG. 32.
Figure 36:
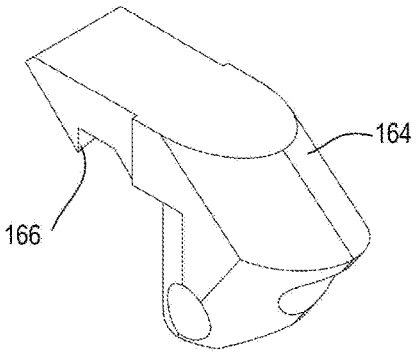
FIG. 36 is a side isometric view of an extractor component of the shotgun conversion shown in FIG. 1.
Figure 37:
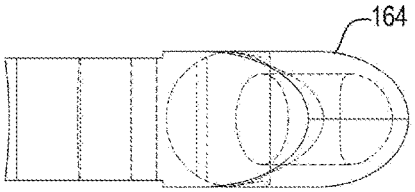
FIG. 37 is a top hidden line view of the extractor component shown in FIG. 36.
Figure 38:
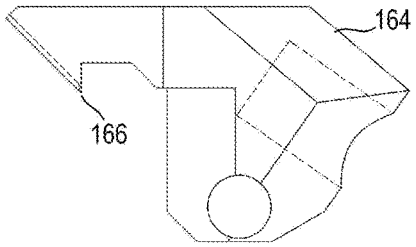
FIG. 38 is a side hidden line view of the extractor component shown in FIG. 36 with the opposing side view being a mirror image thereof.
Figure 39:
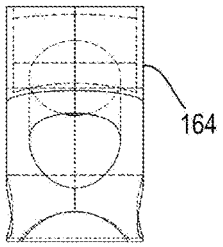
FIG. 39 is a rear hidden line view of the extractor component shown in FIG. 36.
Figure 40:
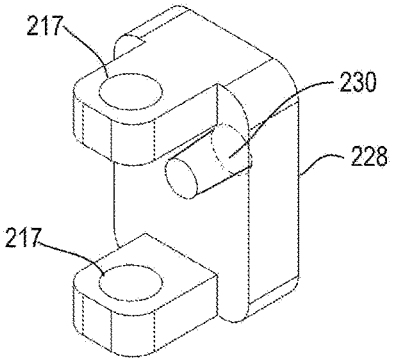
FIG. 40 is an isometric hidden line view of a magazine release pivot mount component of the shotgun conversion shown in FIG. 1.
Figure 41:
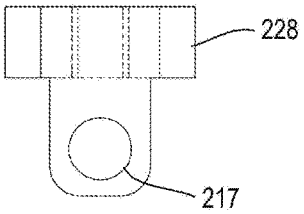
FIG. 41 is a top hidden line view of the magazine release pivot mount component shown in FIG. 40 with the bottom view being a mirror image thereof.
Figure 42:
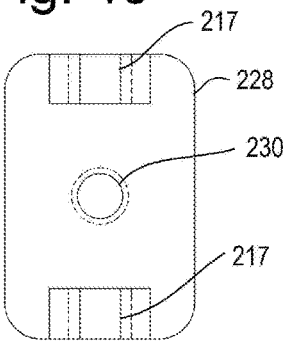
FIG. 42 is a front hidden line view of the magazine release pivot mount component shown in FIG. 40.
Figure 43:
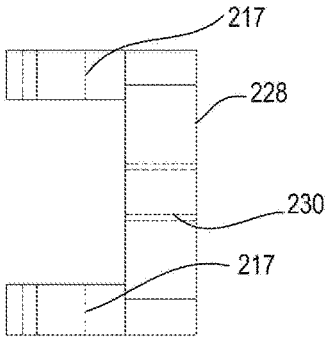
FIG. 43 is a side hidden line view of the magazine release pivot mount component shown in FIG. 40 with the opposing side view being a mirror image thereof.
Figure 44:
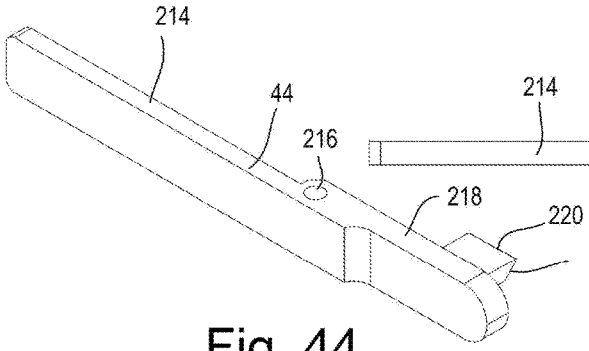
FIG. 44 is a front isometric view of one example of a magazine release lever component of the shotgun conversion shown in FIG. 1.
Figure 45:
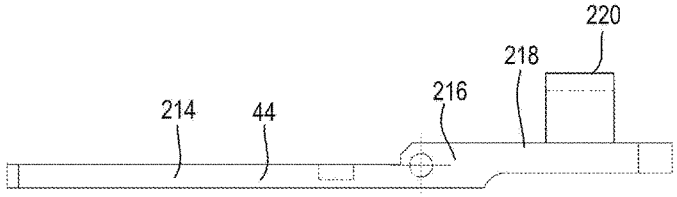
FIG. 45 is a top hidden line view of the magazine release lever component shown in FIG. 44.
Figure 46:
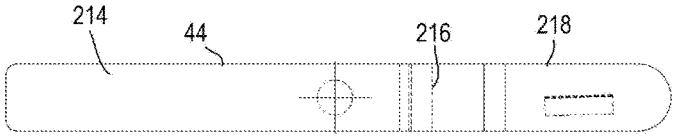
FIG. 46 is a side hidden line view of the magazine release lever component shown in FIG. 44.
Figure 47:
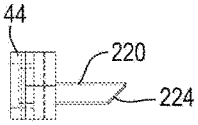
FIG. 47 is a rear hidden line view of the magazine release lever component shown in FIG. 44.

Looking to FIG. 34 it can be seen that the breech face 162 has a reduced diameter region 194 which fits into a surface defining a receiver 196 in the forward end 198 of the bolt body 160. A fastener such as a pin may then be passed or inserted into surfaces defining voids 200 such that it engages a notch 202 in the breech face 162. The fastener, thus installed, prohibits longitudinal movement of the breech face 162 relative to the bolt body 160 however permits some degree of rotational movement of the breech face 162 relative to the bolt body 160. Thus as the bolt body 160 transits rearward, it will rotate due to the shape of the aforementioned notch 184 and a spiral ramp surface 204 as the bolt body 160 and attached components are repositioned forward and rearward during actuation of the modified shotgun 20.

Figure 23:
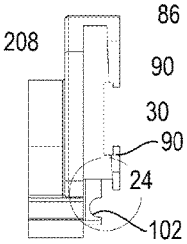
FIG. 23 is a left side view of the stock adapter shown in FIG. 20 of the stock adapter shown in FIG. 19 where the right side view is substantially a mirror image thereof.
Figure 24:
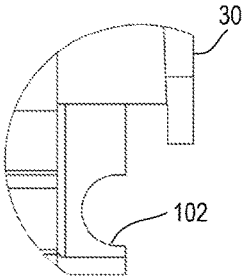
FIG. 24 is an exploded view of the region 24 of FIG. 23.
Figure 25:
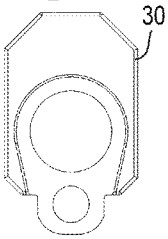
FIG. 25 is a rear view of the stock adapter shown in FIG. 20.
Figure 51:
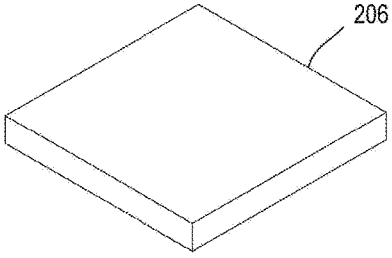
FIG. 51 is a rubber stopper component of the shotgun conversion shown in FIG. 1.
Figure 52:
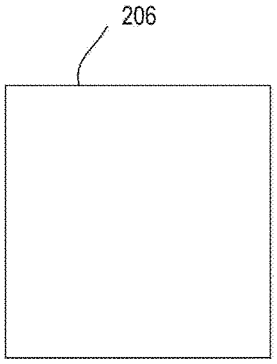
FIG. 52 is a top view of the rubber stopper component shown in FIG. 51 wherein the opposing view is a mirror image thereof area.
Figure 53:
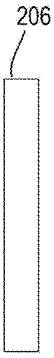
FIG. 53 is a side view of the rubber stop component shown in FIG. 51 wherein the other side view, top view, and bottom view is substantially identical thereto.
Figure 54:
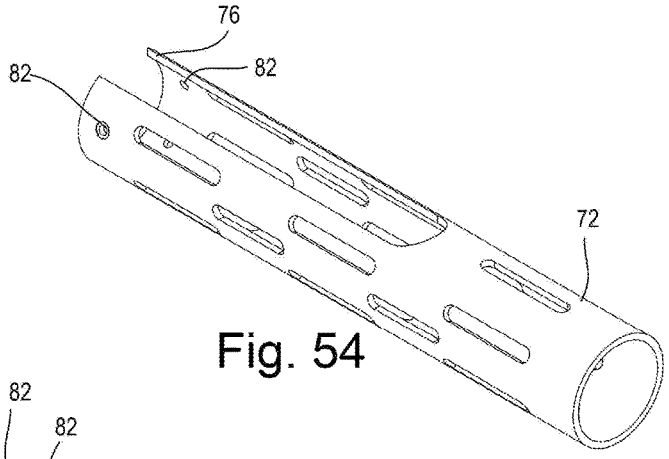
FIG. 54 is a front isometric view of a hand guard component of the shotgun conversion shown in FIG. 1.
Figure 55:
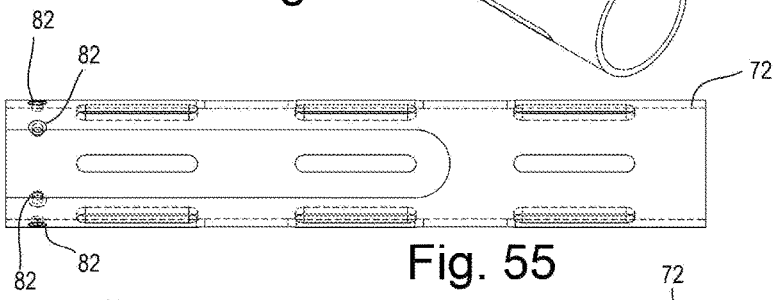
FIG. 55 is a top hidden line view of the hand guard component shown in FIG. 54.
Figure 56:
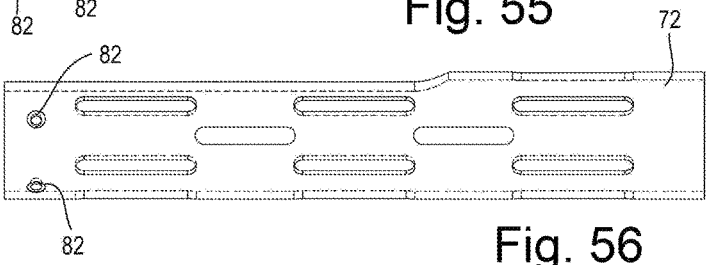
FIG. 56 is a side hidden line view of the hand guard component shown in FIG. 54 wherein the opposing side view is a mirror image thereof.
Figure 57:
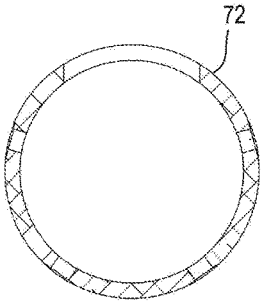
FIG. 57 is a rear view of the hand guard component shown in FIG. 54.

Also shown is a malleable (rubber) stop component 206 shown in FIG. 51-53 which is fitted into a receiving surface 208 in the stock adapter 30 as can be seen in FIG. 23. This malleable stop component 206 reduces impacts and impact damage of the moving components within the receiver 22 as they are pressured rearward by firing of the modified shotgun 20 and would otherwise directly impact the stock adapter 30.

Also shown is a modified magazine release lever 44 which has been previously mentioned. The magazine release lever shown in FIG. 44-47 comprises a rearward component 214 which is rearward of a pivot location 216 and a forward component 218 which is forward of the pivot location 260. A catch protrusion 220 extends laterally from the forward component 218 through a surface 222 in the receiver 22 such that an upper edge of the magazine 48 presses against a load ramp 224 thus rotating the magazine release lever such that the upper edge of the magazine 48 passes the catch protrusion 220 at which point a compression spring between the magazine release lever 44 and the receiver 22 biases the catch protrusion 220 inward thus holding the magazine 48 in position to provide cartridges to the breech face 162 which are inserted into the chamber and fired. Once a user presses the rearward component 214 toward the receiver 22, the magazine release lever 44 rotates. This movement thus releases the magazine 48 from the catch protrusion 220 thus ejecting the magazine 48 from the magazine receiver 28 due to gravity or in some examples this ejection is assisted by way of springs etc.

The magazine release lever 44 in one example is attached to the receiver 22 via a pivot mount 228. The pivot mount 228 may be affixed through surface defining hole 230 in the pivot mount and surface defining hole 232 in the receiver 22 via a threaded fastener. The pivot location 217 aligns with pivot location 216 in the magazine release lever 44 and allows rotation of the magazine release lever 44 relative to the receiver 22. In other examples, the pivot mount 228 is a unitary structure with the receiver 22 or may be adhered, riveted, welded, brazed, or otherwise attached thereto.

Although similar magazine release levers 44 have been utilized, such as in US Patent application 2012/0137869 incorporated herein by reference, the magazine release lever 44 disclosed herein has a rearward component 214 which is substantially longer than those previously known such that the magazine release lever 44 extends rearward beyond a vertical plane 46 which is orthogonal to the barrel 40 of the shotgun 20 and is aligned with the trigger 226. This allows the user to easily release the magazine 48 without removing their hand from the grip 24 as the magazine release 44 extends rearward of the magazine receiver 28 to a more easily reached position relative to the trigger 226.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

The invention claimed is:

1. A shotgun comprising:

a receiver a trigger, and safety attached to the receiver;

a barrel attached to the receiver;

a surface defining a gas port in the barrel;

wherein the gas port is aligned with a surface defining a vent passage in an upper gas block component of a gas block assembly;

wherein the vent passage extends into an inner chamber of the upper gas block;

the upper gas block fixed to the barrel by way of a lower gas block;

the lower gas block removably attached to the upper gas block;

wherein inner surfaces of the lower gas block and upper gas block clamp around the outer surface of the barrel thus positioning the vent passage in fluid connection with the gas port;

wherein a rearward end of the upper gas block is attached to a gas tube;

the gas tube having an opposing longitudinal end inserted into a female surface of the upper receiver;

a piston comprising a rod component and a sealing component positioned within the upper gas block;

a gas cap positioned within the upper gas block wherein a radially outer surface of the gas cap threads into a female threaded surface of the upper gas block such that rotation of the gas cap will result in longitudinal movement of a gas plug;

the gas plug comprises an angled surface adjacent the vent passage;

the gas plug comprising a portion configured so that the gas plug does not rotate when the gas cap is rotated; and as the gas cap is rotated, the cap and gas plug reposition longitudinally forward and rearward relative to the upper gas block thus adjusting the volume and pressure of air passing through the vent passage upon the face of the piston.

2. The shotgun as recited in claim 1 wherein an outer surface of a plurality of radially extending rings engage the inner surface of the upper gas block and seal thereto prohibiting the free flow of gas past the sealing component.

3. The shotgun as recited in claim 1 comprising a barrel mounting system allowing for a slide-in barrel with a removable gas block assembly attached thereto.

4. The shotgun as recited in claim 1 further comprising a stock adapter mounted via tapered vertical dovetails to the rear end of the receiver.

5. The shotgun as recited in claim 1 comprising a receiver for a tactical style shotgun wherein the upper receiver comprises a plurality of aluminum components which are vertically separated and laterally attached to each other via removable fasteners.

6. The shotgun as recited in claim 1 further comprising a magazine release mechanism attached to a shotgun magazine release catch wherein the magazine release mechanism extends longitudinally rearward at least to a vertical plane aligned with a trigger of a firearm.

7. The shotgun as recited in claim 1 comprising a carrier comprising laterally extending wings which slide within grooves in the receiver, the carrier further having a plurality of planar surfaces which slide against planar surfaces within the receiver.

8. The shotgun as recited in claim 1 wherein the receiver is split along a vertical axis.

9. The shotgun as recited in claim 1 further comprising a mil spec AR15 grip attached to the receiver.

10. The shotgun as recited in claim 1 wherein the portion configured to be engaged to ensure that the gas plug does not rotate when the gas cap is rotated protrudes through the gas cap.

* * * * *